US009776818B2

(12) United States Patent
Hamaya

(10) Patent No.: US 9,776,818 B2
(45) Date of Patent: Oct. 3, 2017

(54) IMAGE-FORMING APPARATUS

(71) Applicant: Konica Minolta, Inc., Chiyoda-ku, Tokyo (JP)

(72) Inventor: Satoshi Hamaya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/159,081

(22) Filed: May 19, 2016

(65) Prior Publication Data

US 2016/0355359 A1 Dec. 8, 2016

(30) Foreign Application Priority Data

Jun. 3, 2015 (JP) ..... 2015-112979

(51) Int. Cl.
*B65H 9/00* (2006.01)
*B65H 5/06* (2006.01)
(Continued)

(52) U.S. Cl.
CPC ..... *B65H 5/062* (2013.01); *B65H 9/002* (2013.01); *G03G 15/6564* (2013.01);
(Continued)

(58) Field of Classification Search
CPC .... B65H 9/002; B65H 9/00; B65H 2404/722; B65H 2404/723
(Continued)

(56) References Cited

U.S. PATENT DOCUMENTS 7,753,370 B2 * 7/2010 Inoue ..... B65H 1/04 271/234
7,986,912 B2 * 7/2011 Maruyama ..... G03G 15/6564 271/226
(Continued)

FOREIGN PATENT DOCUMENTS

JP H05124752 A 5/1993
JP 2008001473 A 1/2008
JP 2008056476 A 3/2008

OTHER PUBLICATIONS

Notification of Rejection Reasons corresponding to JP Application No. 2015-112979; dated May 2, 2017.
(Continued)

*Primary Examiner* — Howard Sanders
(74) *Attorney, Agent, or Firm* — Cantor Colburn LLP

(57) ABSTRACT

An image-forming apparatus contains an image-forming portion, a first conveying portion that is arranged at an upstream side of the image-forming portion along a sheet conveying direction, a second conveying portion that is arranged at an upstream side of the first conveying portion along the sheet conveying direction and a control portion. The control portion controls the first conveying portion to move a pair of registration rollers along a direction that is orthogonal to the sheet conveying direction while the pair of registration rollers nips the sheet when conveying the sheet to the image-forming portion. The control portion controls the second conveying portion to move one of the pair of conveying rollers along the direction that is orthogonal to the sheet conveying direction while the pair of conveying rollers does not nip the sheet.

10 Claims, 5 Drawing Sheets

(51) Int. Cl.
*G03G 15/00* (2006.01)
*G03G 15/23* (2006.01)

(52) U.S. Cl.
CPC ... *G03G 15/6567* (2013.01); *B65H 2404/723* (2013.01); *G03G 15/234* (2013.01); *G03G 2215/0135* (2013.01)

(58) Field of Classification Search
USPC ..... 271/252
See application file for complete search history.

(56) References Cited

U.S. PATENT DOCUMENTS

| | | | | |
|---|---|---|---|---|
| 8,851,470 | B2 * | 10/2014 | Matsumoto | B65H 7/10 271/228 |
| 9,022,384 | B2 * | 5/2015 | Hasegawa | B65H 5/062 271/245 |
| 2007/0284810 | A1 * | 12/2007 | Nakazawa | B65H 9/002 271/228 |
| 2007/0296141 | A1 | 12/2007 | Inoue | |

OTHER PUBLICATIONS

SIPO First Office Action of the corresponding Chinese Application No. 201610388646.0; dated Jun. 1, 2017.

* cited by examiner

IMAGE-FORMING APPARATUS

CROSS REFERENCE TO RELATED APPLICATION

The present invention contains subject matter related to Japanese Patent Application JP 2015-112979 filed in the Japanese Patent Office on Jun. 3, 2015, the entire contents of which being incorporated herein by reference.

BACKGROUND OF THE INVENTION

Field of the Invention

The present invention relates to an image-forming apparatus that inhibits a crinkle from occurring on a sheet when performing a deviation correction on the sheet.

Description of Related Art

An image-forming apparatus adopting an electrophotographic system and combining plural functions such as a printer, a copier, a facsimile or the like has been widely utilized in the past. In the image-forming apparatus, the sheet is conveyed to a transfer portion via a linear path and a curved path. There, however, may be a case where the sheet is conveyed with it being deviated because of any mechanical factor such as any error in a roller when manufacturing it and time-related deterioration. In such a case, since the sheet is conveyed to the transfer portion with it being deviated from an image-forming position, a printing position of an image on the sheet is also deviated. This may fail to print the image with high precision.

Accordingly, in order to align the image with an image-printing position of the sheet with high precision, a registration fluctuation correction is carried out to correct a deviation of the sheet by moving the sheet to a sheet width direction while registration rollers nip the sheet. For example, Japanese Patent Application Publication No. H05-124752 discloses moving the sheet to the sheet width direction while registration rollers and pre-registration rollers nip the sheet when performing alignment of the sheet along the sheet width direction.

SUMMARY OF THE INVENTION

However, in the image-forming apparatus described in Japanese Patent Application Publication No. H05-124752, when performing the registration fluctuation correction, there may be a case where any errors occur in amounts of movement between the registration rollers and the pre-registration rollers along the sheet width direction. In this case, any stress may occur on the conveying sheet and a crinkle may occur on the sheet. Therefore, it has proposed to relieve the errors in the amount of movement between the registration rollers and the pre-registration rollers by releasing the pre-registration rollers from each other and stopping fluctuation of the pre-registration rollers.

Nevertheless, it has been confirmed to generate another issue when passing the sheet through a curved path such as a sheet-reversing path in which the sheet is reversed. The sheet-reversing path partially has a semi-circular curved path. Even when the conveying rollers arranged on the curved path are released and stop fluctuation thereof, the sheet may contact the conveying rollers when passing the sheet through the curved path. Corrosion (pressure) or the like occurred at this moment may cause any crinkles to occur on the sheet because the sheet does not catch up the movement of the registration rollers of downstream side along the sheet width direction. Particularly, when thick paper, a large size sheet or a sheet having heavy paper weight is used, they apply any strong pressure to the conveying rollers arranged on the curved path, so that the above-mentioned issue has been remarkably exhibited.

The present invention addresses the above-described issue. The present invention has objects to provide an image-forming apparatus that inhibits a crinkle from occurring on a sheet when performing a deviation correction on the sheet.

To achieve at least one of the above-described objects, an image-forming apparatus contains an image-forming portion that forms an image on a sheet, a first conveying portion that is arranged at an upstream side of the image-forming portion along a sheet conveying direction and includes a pair of conveying members, a second conveying portion that is arranged at an upstream side of the first conveying portion along the sheet conveying direction and includes a pair of conveying members, and a control portion that controls the first conveying portion to move the pair of conveying members of the first conveying portion along a direction that is orthogonal to the sheet conveying direction while the pair of conveying members of the first conveying portion nips the sheet, when conveying the sheet to the image-forming portion, and controls the second conveying portion to move at least one of the pair of conveying members of the second conveying portion along the direction that is orthogonal to the sheet conveying direction while the pair of conveying members of the second conveying portion inhibits the sheet from being nipped.

According to embodiments of the present invention, it is desired to provide the image-forming apparatus wherein the control portion sets start time of the movement of at least one of the pair of conveying members of the second conveying portion along the direction that is orthogonal to the sheet conveying direction to be before start time of the movement of the pair of conveying members of the first conveying portion along the direction that is orthogonal to the sheet conveying direction.

It is also desired to provide the image-forming apparatus wherein the control portion sets an amount of the movement of at least one of the pair of conveying members of the second conveying portion along the direction that is orthogonal to the sheet conveying direction to be larger than an amount of the movement of the pair of conveying members of the first conveying portion along the direction that is orthogonal to the sheet conveying direction.

It is further desired to provide the image-forming apparatus wherein the second conveying portion is arranged on a curved portion of a conveying path.

It is additionally desired to provide the image-forming apparatus wherein the control portion sets an amount of the movement of at least one of the pair of conveying members of the second conveying portion along the direction that is orthogonal to the sheet conveying direction based on a paper weight of the sheet, species of sheet or a size of the sheet.

It is still also desired to provide the image-forming apparatus wherein the first conveying portion includes a pair of registration rollers.

It is still further desired to provide the image-forming apparatus wherein the pair of conveying members of the second conveying portion includes a driving roller and a driven roller, and the control portion controls the second conveying portion to move the driving roller along the direction that is orthogonal to the sheet conveying direction.

It is still additionally desired to provide the image-forming apparatus wherein the pair of conveying members of the second conveying portion includes a driving roller and a driven roller, and the control portion controls the second conveying portion to move the driven roller along the direction that is orthogonal to the sheet conveying direction.

Other objects and attainments of the present invention will be become apparent to those skilled in the art upon a reading of the following detailed description when taken in conjunction with the drawing.

DESCRIPTION OF THE PREFERRED EMBODIMENTS

Figure 1:
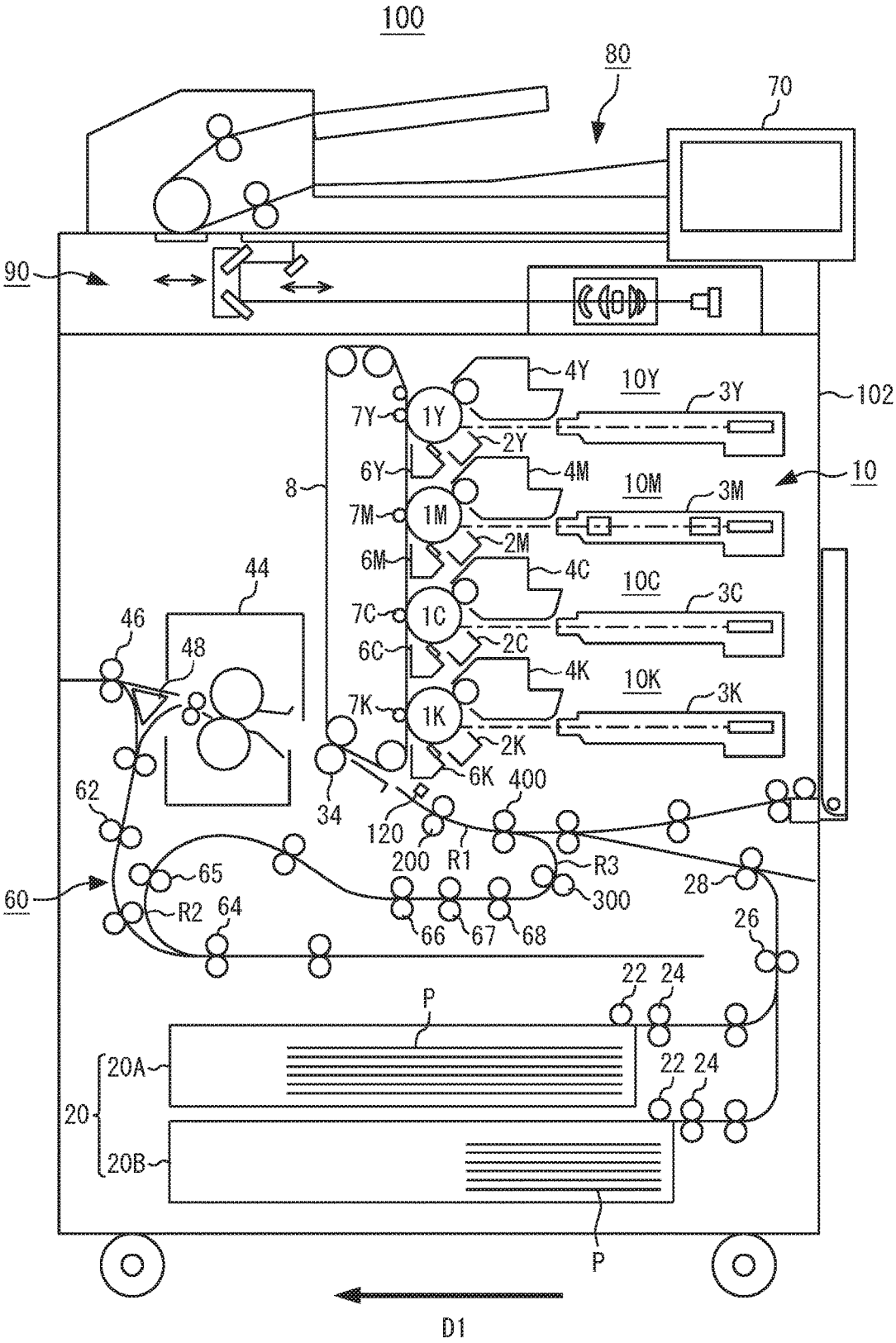
FIG. 1 is a diagram showing a configuration example of an image-forming apparatus according to an embodiment of the invention.

The following will describe preferred embodiments of an image-forming apparatus according to the present invention with reference to the attached drawings. Such description does not limit the technical scope, meaning of terms and the like in Claims. Size and/or ratio in the drawings are exaggerated for convenience of explanation and they may be different from real ones.

<Configuration Example of Image-Forming Apparatus 100 according to Embodiment of Invention>

FIG. 1 schematically shows an image-forming apparatus 100 according to an embodiment of the invention. As shown in FIG. 1, the image-forming apparatus 100 is a color image-forming apparatus of a so-called tandem type. The image-forming apparatus 100 is provided with an automatic document feeder 80 and an apparatus main body 102. The automatic document feeder 80 is mounted on the apparatus main body 102. The automatic document feeder 80 feeds the document(s) set on a feeding table to an image-reading portion 90 of the apparatus main body 102 using conveying rollers and the like.

The apparatus main body 102 contains a manipulation/display portion 70, the image-reading portion 90, an image-forming portion 10, an intermediate transfer belt 8, a feeder 20, a first conveying portion (registration unit) 200, a deviation detection sensor 120, a fixing portion 44 and an auto duplex unit (ADU) 60.

The manipulation/display portion 70 contains a touch panel combining a display device with a position input device, and plural manipulation keys including a start key, a determination key and the like, which are arranged around the touch panel. The manipulation/display portion 70 displays a manipulation screen and the like and receives any image-forming conditions such as species of sheet and paper weight of the sheet, which a user inputs using the manipulation screen and/or through the manipulation keys.

The image-reading portion 90 scans and exposes an image on the document mounted on the document table or fed by the automatic document feeder 80 using an optical system of a scanning and exposing device. The image-reading portion 90 also performs photoelectric conversion on the scanned image of the document by a charge couple device (CCD) image sensor to obtain an image information signal. An image-processing portion, not shown, performs analog processing, analog/digital (A/D) conversion processing, shading processing, image compression processing and like on the image information signal to output the processed signal to the image-forming portion 10.

The image-forming portion 10 forms the image according to the electrophotographic system. The image-forming portion 10 includes an image-forming unit 10Y which forms a yellow (Y) image, an image-forming unit 10M which forms a magenta (M) image, an image-forming unit 10C which forms a cyan (C) image and an image-forming unit 10K which forms a black (K) image. In this embodiment, respective common function names are represented by Y, M, C and K indicating respective colors to be formed following, for example, the numeral 10.

The image-forming unit 10Y contains a photosensitive drum 1Y, a charging portion 2Y positioned around the photosensitive drum 1Y, an exposing portion 3Y, a developing portion 4Y and a drum cleaner 6Y. Similarly, the image-forming unit 10M contains a photosensitive drum 1M, a charging portion 2M positioned around the photosensitive drum 1M, an exposing portion 3M, a developing portion 4M and a drum cleaner 6M. The image-forming unit 10C contains a photosensitive drum 1C, a charging portion 2C positioned around the photosensitive drum 1C, an exposing portion 3C, a developing portion 4C and a drum cleaner 6C. The image-forming unit 10K contains a photosensitive drum 1K, a charging portion 2K positioned around the photosensitive drum 1K, an exposing portion 3K, a developing portion 4K and a drum cleaner 6K.

The photosensitive drum 1Y, 1M, 1C and 1K, the charging portion 2Y, 2M, 2C and 2K, the exposing portion 3Y, 3M, 3C and 3K, the developing portion 4Y, 4M, 4C and 4K and the drum cleaner 6Y, 6M, 6C and 6K in the image-forming unit 10Y, 10M, 10C and 10K respectively have the common configurations. Accordingly, the following will describe them without indicating Y, M, C and K, unless their distinctions require.

The charging portion 2 charges a static charge uniformly around the surface of the photosensitive drum 1. The exposing portion 3 is composed of, for example, an LED print head (LPH) including an LED array and imaging lenses or a laser exposure and scanning device of polygon mirror system. The exposing portion 3 scans and exposes a surface of the photosensitive drum 1 by laser light based on the image information signal to form an electrostatic latent image on the photosensitive drum 1. The developing portion 4 develops the electrostatic latent image formed on the photosensitive drum 1 by using toner. Accordingly, a visible toner image is formed on the photosensitive drum 1.

The intermediate transfer belt 8 is stretched from plural rollers and the like and is rotatably supported by them. The primary transfer rollers 7 and the photosensitive drum 1 rotate accompanying with the rotation of the intermediate transfer belt 8. By applying a predetermined voltage across the primary transfer rollers 7 and the photosensitive drum 1, the toner image formed on the photosensitive drum 1 is transferred onto the intermediate transfer belt 8 (Primary Transfer).

The feeder 20 contains plural feeding trays 20A, 20B and the like, each tray storing the sheets P such as sheets of A3 size or A4 size. Rollers 22, 24, 26, 28 and the like convey the sheet P from any of the feeding trays 20A and 20B to a first conveying portion 200. Numbers of the feeding trays are not limited to two. Further, if necessary, single or plural large capacity sheet feeding apparatuses which can store a large number of sheets P may be connected to this image-forming apparatus.

The first conveying portion 200 corrects any skew of the sheet by striking a forward end of the sheet against the first conveying portion 200 accompanying with conveyance of the third conveying portion 400 to form a loop. When correcting the skew of the sheet, the first conveying portion 200 conveys the sheet P. Further, the first conveying portion 200 fluctuates (moves) the sheet along a direction D2 (hereinafter, referred to as "sheet width direction D2") that is orthogonal to the sheet conveying direction D1 with the sheet P being nipped based on the detection result of the deviation detection sensor 120 to correct the deviation of the sheet P.

The corrected sheet P is then conveyed to a secondary transfer portion 34. The secondary transfer portion 34 transfer each color toner image of Y, M, C or K transferred onto the intermediate transfer belt 8 to a surface of the sheet P conveyed by the first conveying portion 200 in a lump (Secondary Transfer). The secondary transfer portion 34 conveys the sheet P on which the secondary transfer is performed to the fixing portion 44, which is arranged at a downstream side of the secondary transfer portion 34, along the sheet conveying direction D1.

The fixing portion 44 is provided with a pressure roller, a heating roller, a fixing belt and the like. The fixing portion 44 performs pressure and heat processing on the sheet P, to which the secondary transfer portion 34 has transferred the toner images, to fix the toner images formed on the surface of the sheet P.

A change-over gate 48 for changing over the conveying route of the sheet P to a sheet-ejection side or a side of ADU 60 is arranged at a downstream side of the fixing portion 44 along the sheet conveying direction D1. The change-over gate 48 performs a changing-over control of conveying route based on a selected printing mode (one-side printing mode, duplex printing mode or the like).

Sheet-ejection rollers 46 eject the sheet P, one surface of which is printed in the one-side printing mode or both surfaces of which are printed in the duplex printing mode, to a sheet-ejection tray, not shown.

Further, when the image is formed on the reverse surface of the sheet P in the duplex printing mode, transfer rollers 62 and the like convey the sheet P in which an image has been already formed on the surface thereof to ADU 60. In a switchback route of ADU 60, conveying rollers 65, 66, 67, 68 and the second conveying portion 300 provided on the curved paths R2 and R3 (U-turn transfer path) reverse the sheet P with a rear end of the sheet P going ahead under reverse rotation control of ADU rollers 64. The conveying rollers 65 and the like again convey the sheet P to the secondary transfer portion 34 with the sheet P being reversed.

<Configuration Examples of First Conveying Portion 200 and Second Conveying Portion 300>

Figure 2:
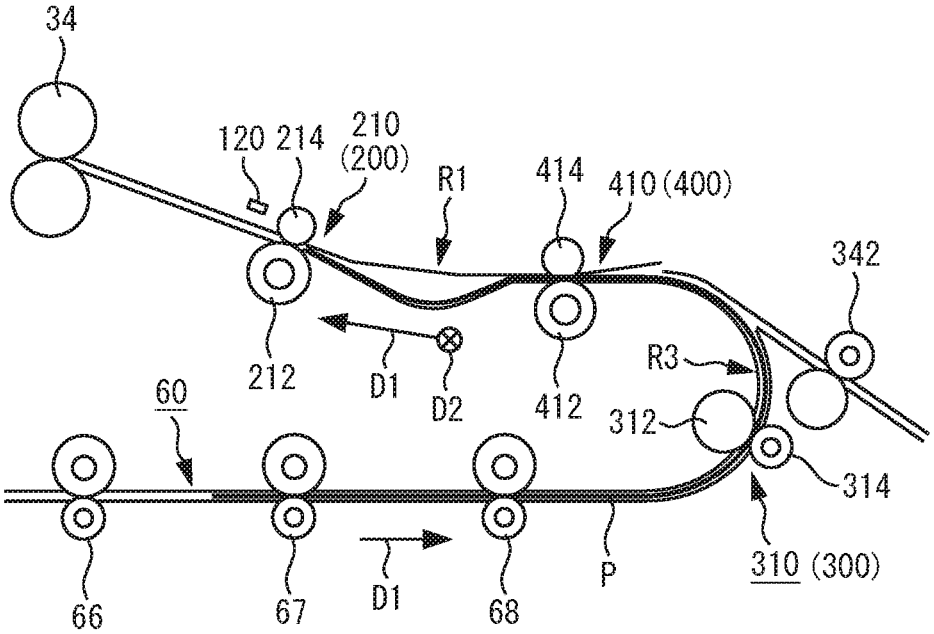
FIG. 2 is a diagram showing a configuration example of first and second conveying portions.

FIG. 2 shows a configuration example of the first conveying portion 200 and the second conveying portion 300. As shown in FIG. 2, the first conveying portion 200 is positioned at upstream side of the secondary transfer portion 34 on a conveying path R1 extending from an entrance of the apparatus main body 102 shown in FIG. 1 to the secondary transfer portion 34 along the sheet conveying direction D1. The first conveying portion 200 contains a pair of the registration rollers 210. The pair of the registration rollers 210 contains a driving roller 212 and a driven roller 214 that is arranged so as to be opposite to the driving roller 212. The driving roller 212 is configured to be able to fluctuate along the sheet width direction D2. The driven roller 214 is configured so as to be contacted to the driving roller 212 or released therefrom.

The second conveying portion 300 is positioned at upstream side of the first conveying portion 200 on a curved path R3 of ADU 60 along the sheet conveying direction D1. The second conveying portion 300 contains a pair of conveying rollers 310. The pair of conveying rollers 310 contains a driving roller 312 and a driven roller 314 that is arranged so as to be opposite to the driving roller 312. The driving roller 312 is arranged inside the curved path R3 and is configured so as to be able to fluctuate along the sheet width direction D2. The driven roller 314 is arranged outside the curved path R3 and is configured so as to be contacted to the driving roller 312 or released therefrom. The driving roller 312 and the driven roller 314 are made of, for example, resin materials such as rubber.

The deviation detection sensor 120 is positioned at downstream side of the first conveying portion 200 along the sheet conveying direction D1. The deviation detection sensor 120 is composed of a line sensor in which photoelectronic converting elements are arranged in a line, an image sensor in which photoelectronic converting elements are arranged in a matrix or the like. The deviation detection sensor 120 detects a position of an edge of the sheet P conveyed by the first conveying portion 200 along the sheet width direction D2. The position of an edge of the sheet P is regulated on the basis of an image center (a center of the sheet width direction).

<Configuration Example of Fluctuation Mechanism 250 in First Conveying Portion 200>

Figure 3:
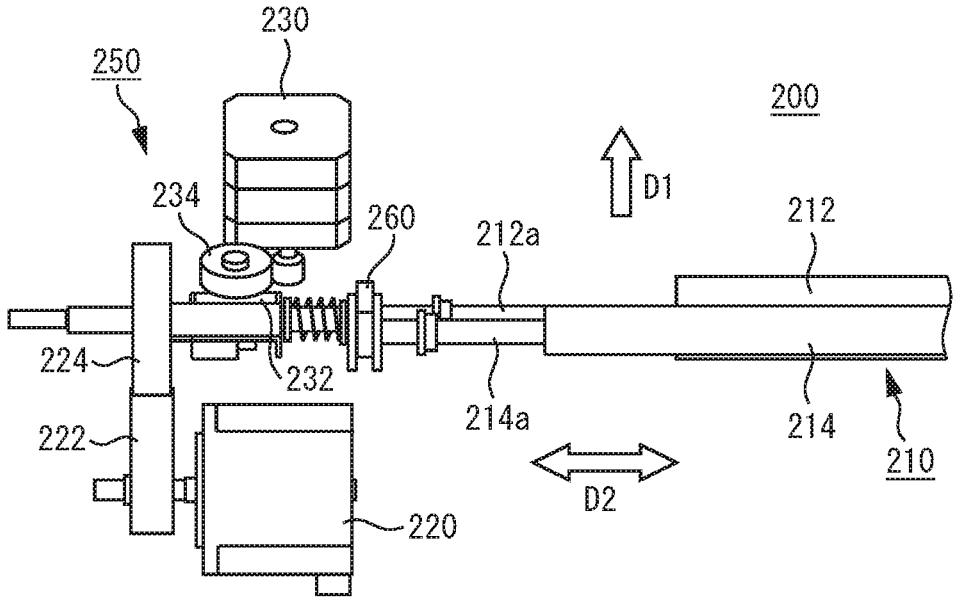
FIG. 3 is a diagram showing a configuration example of a fluctuation mechanism of the first conveying portion.

FIG. 3 shows the first conveying portion 200 viewed from above, particularly shows a configuration example of a fluctuation mechanism 250. The fluctuation mechanism 250 of the first conveying portion 200 adopts known technologies so that the detailed explanation thereof will be omitted.

As shown in FIG. 3, the first conveying portion 200 contains a pair of registration rollers 210 having the driving roller 212 and the driven roller 214, a driving motor 220 and the fluctuation mechanism 250. The fluctuation mechanism 250 contains a fluctuation motor 230, a rack 232 and a pinion 234.

The driving motor 220 is connected with a shaft 212*a* of the driving roller 212 via power transmission system including gears 222, 224. The driving motor 220 is composed of, for example, a stepping motor and is driven to rotate the driving roller 212 and the driven roller 214 via the gears 222, 224 to convey the sheet P along the sheet conveying direction D1.

The fluctuation motor 230 is connected with a shaft 212*a* of the driving roller 212 via power transmission system including the rack 232 and the pinion 234. The rack 232 is a cylinder member having a bearing on its inner surface and teeth on its outer surface. The rack 232 is attached to the shaft 212*a* of the driving roller 212. The pinion 234 is meshed with a rotation shaft (gear) of the driving motor 230 and the rack 232, respectively. The shaft 212*a* of the driving roller 212 and the shaft 214*a* of the driven roller 214 are coupled to each other by a coupling member 260. The fluctuation motor 230 is composed of, for example, a stepping motor and is driven to fluctuate the driving roller 212 and the driven roller 214 via the pinion 234 and the rack 232 along the sheet width direction D2.

Additionally, the above-mentioned fluctuation mechanism 250 of the first conveying portion 200 can be also adopted for the fluctuation mechanism of the second conveying portion 300. Accordingly, a detailed explanation of the fluctuation mechanism of the second conveying portion 300 will be omitted. In the second conveying portion 300, the driving roller 312 of the pair of the conveying rollers 310 is solely fluctuated along the sheet width direction D2 so that the coupling member that couples the driving roller 312 and the driven roller 314 in the fluctuation mechanism 250 of the first conveying portion 200 is not required.

<Configuration Example of Image-Forming Apparatus 100>

Figure 4:
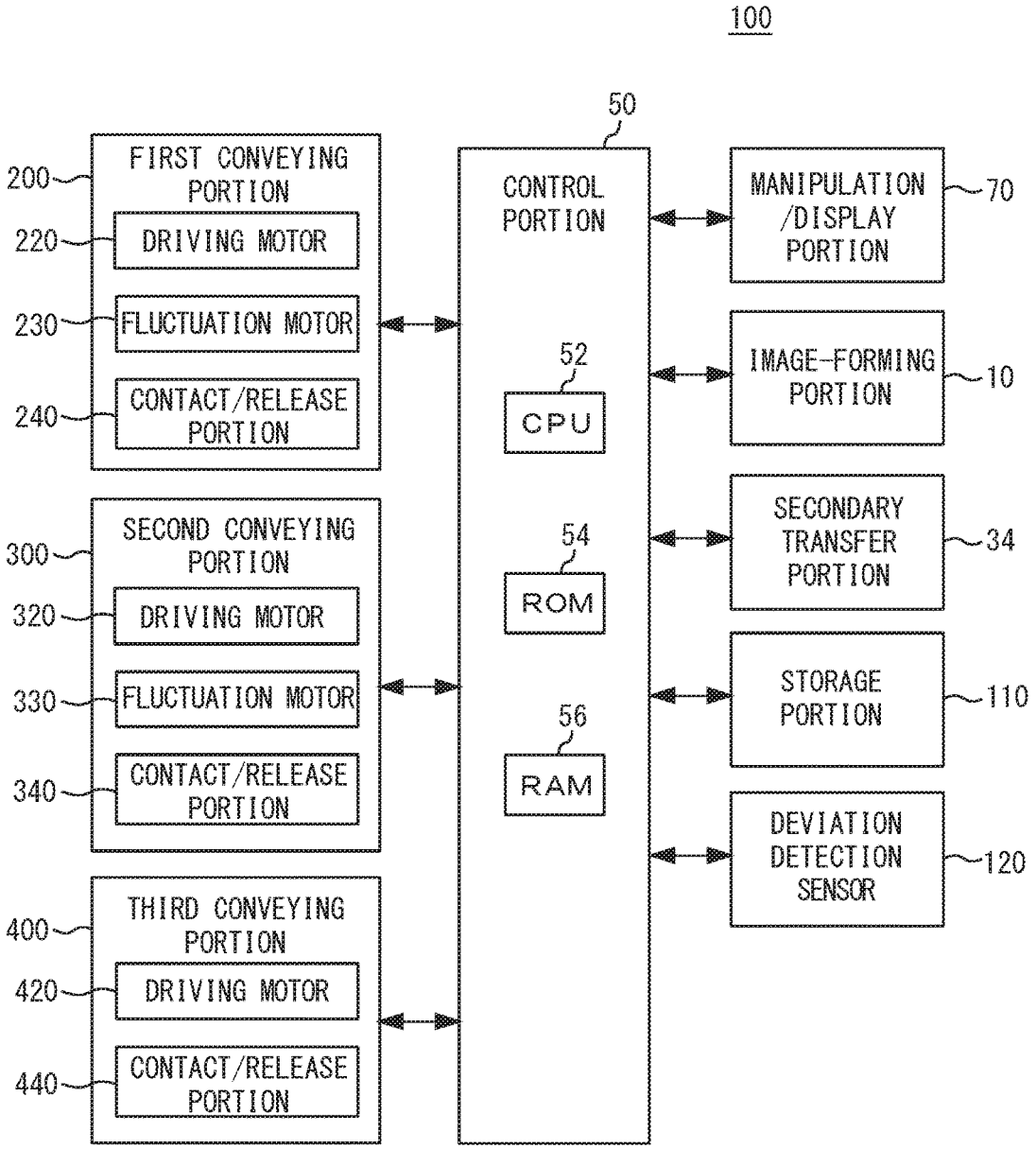
FIG. 4 is a block diagram showing a functional configuration example of the image-forming apparatus.

FIG. 4 shows a functional configuration example of the image-forming apparatus 100 according to an embodiment of the invention. As shown in FIG. 4, the image-forming apparatus 100 includes a control portion 50 for controlling an operation of the entire apparatus. The control portion 50 includes a central processing unit (CPU) 52, a read only memory (ROM) 54 and a random access memory (RAM) 56. CPU 52 expands extracts any software (programs) readout of ROM 54 on RAM 56 and carries out it to control every portion of the image-forming apparatus 100, thereby realizing any functions relating to image formation including registration fluctuation correction.

The control portion 50 acquires a fluctuation command value (an amount of fluctuation) when the first conveying portion 200 and the second conveying portion 300 are fluctuated along the sheet width direction D2 based on the position of the end portion of the sheet detected by the deviation detection sensor 120. In this moment, the control portion 50 can set the fluctuation command value, by taking into consideration paper weight, species and size of the sheet P to be printed, temperature and humidity in the apparatus and the like. The image-forming condition such as paper weight of the sheet P may be acquired from a computer, not shown, connected by the manipulation/display portion 70 or through a network. The control portion 50 carries out the registration fluctuation correction in which the first conveying portion 200 and the second conveying portion 300 are fluctuated along the sheet width direction D2 based on the acquired fluctuation command value.

The control portion 50 is connected with the manipulation/display portion 70, the image-forming portion 10, the secondary transfer portion 34, a storage portion 110, the first conveying portion 200, the second conveying portion 300, the third conveying portion 400 and the deviation detection sensor 120, respectively.

The storage portion 110 is composed of, for example, a non-volatile semiconductor memory (so-called flash memory) or hard disk drive (HDD). The storage portion 110 stores, for example, any acquired image data, the fluctuation command value indicating an amount of fluctuation of the pair of registration rollers 210 and the like.

The first conveying portion 200 includes the driving motor 220, the fluctuation motor 230 and a contact/release portion 240. The driving motor 220 is driven on the basis of a driving signal received from the control portion 50 to rotate the driving roller 212. The fluctuation motor 230 is driven on the basis of a driving signal received from the control portion 50 to fluctuate the driving roller 212 along the sheet width direction D2.

The contact/release portion 240 includes, for example, a driving motor, a belt, a cam mechanism and the like. The contact/release portion 240 is driven on the basis of an instruction from the control portion 50 to contact the driven roller 214 with the driving roller 212 or to release the driven roller 214 from the driving roller 212.

The second conveying portion 300 includes the driving motor 320, the fluctuation motor 330 and a contact/release portion 340. The driving motor 320 is driven on the basis of a driving signal received from the control portion 50 to rotate the driving roller 312. The fluctuation motor 330 is driven on the basis of a driving signal received from the control portion 50 to fluctuate the driving roller 312 along the sheet width direction D2.

The contact/release portion 340 includes, for example, a driving motor, a belt, a cam mechanism and the like. The contact/release portion 340 is driven on the basis of an instruction from the control portion 50 to contact the driven roller 314 with the driving roller 312 or to release the driven roller 314 from the driving roller 312.

The third conveying portion 400 includes a driving motor 420 and a contact/release portion 440. The driving motor 420 is driven on the basis of a driving signal received from the control portion 50 to rotate a driving roller 412 constituting a pair of loop rollers 410.

The contact/release portion 440 includes, for example, a driving motor, a belt, a cam mechanism and the like. The contact/release portion 440 is driven on the basis of an instruction from the control portion 50 to contact the driven roller 414 with the driving roller 412 or to release the driven roller 414 from the driving roller 412 (see FIG. 2).

The control portion 50 also controls operations of the manipulation/display portion 70, the image-forming portion 10, the secondary transfer portion 34, the deviation detection sensor 120 and the like.

<Operation Example of Image-Forming Apparatus 100 according to Embodiment of Invention>

Figure 5:
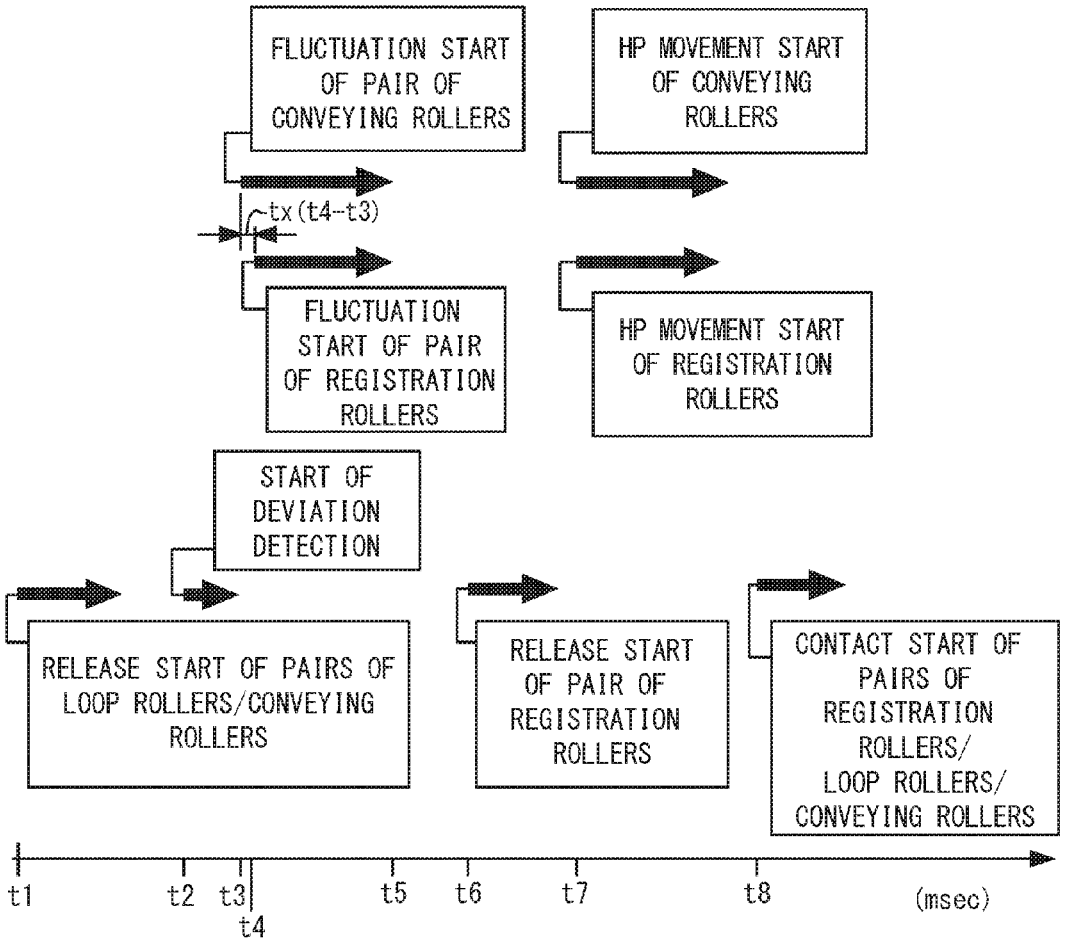
FIG. 5 is a chart showing an operation example of the image-forming apparatus when the image-forming apparatus performs registration fluctuation correction.

FIG. 5 shows an operation example of the image-forming apparatus 100 when the image-forming apparatus performs registration fluctuation correction.

In FIG. 5, a horizontal axis indicates time and a period of time from t1 to t8 is set to become, for example, about 500 msec. The following will describe a case where the sheet P, a surface of which an image has been formed during the duplicate printing, contacts the driving roller 312 of the pair of the conveying rollers 310 when the sheet P passes through the curved path R3 of ADU 60.

The control portion 50 carries out the program read out of Rom 54 or the like to realize the processing according to a flowchart shown in FIG. 5. First, the control portion 50 reversely rotates the pair of registration rollers 210 which is a pair of conveying members of the first conveying portion or stops rotating them when the sheet P reaches the pair of registration rollers 210. The control portion 50 controls the pair of loop rollers 410 to rotate so that the sheet P is conveyed and is looped by a predetermined amount thereof, thereby correcting the skew of the sheet P.

Next, as shown in FIG. 5, at time t1, the control portion 50 controls the contact/release portion 340 to release the contact of the pair of the conveying rollers 310 which are a pair of conveying members of the second conveying portion so as to become away from each other. The control portion 50 also controls the contact/release portion 340 to release the contact of the pair of the loop rollers 410 so as to become away from each other. The control portion 50 controls the driving motor 220 to be driven so that the pair of registration rollers 210 can rotate. Thus, the sheet P is transferred to the pair of registration rollers 210 which conveys the sheet P. is conveyed At time t2, the deviation detection sensor 120 detects a position (an amount of deviation) of an edge of the sheet P conveyed by the pair of registration rollers 210 along the sheet width direction D2 based on the instruction of the control portion 50.

When the deviation detection is completed, at time t3, the control portion 50 acquires a fluctuation instruction value (correction value) based on a result of deviation detection by the deviation detection sensor 120. The control portion 50 controls the fluctuation motor 330 to drive based on the acquired fluctuation instruction value so that the driving roller 312 of the pair of conveying rollers 310 fluctuates to the sheet width direction D2. In this embodiment, as described later, since the driving roller 312 fluctuates at timing earlier than that of the pair of registration rollers 210, the fluctuation instruction value of the driving roller 312 is calculated so as to be some more than the fluctuation instruction value of the pair of registration rollers 210.

At time t4, the control portion 50 acquires a fluctuation instruction value based on a result of deviation detection by the deviation detection sensor 120. The control portion 50 controls the fluctuation motor 230 to drive based on the acquired fluctuation instruction value so that the pair of registration rollers 210 fluctuates to the sheet width direction D2. Thus, in this embodiment, fluctuation start time of the driving roller 312 of the pair of conveying rollers 310 which are a pair of conveying member of the second conveying portion is controlled so that the fluctuation of the driving roller 312 starts faster by time tx, t4-t3 than fluctuation start time of the pair of registration rollers 210 which are a pair of conveying member of the first conveying portion. In other words, the control portion 50 controls the fluctuation so that an amount of fluctuation of the pair of conveying rollers 310 along the sheet width direction D2 is more than an amount of fluctuation of the pair of registration rollers 210 along the sheet width direction D2. This is because a time lag by backlash of gears constituting the pair of conveying rollers 310 is taken into consideration.

The sheet P is conveyed along the sheet conveying direction D1 while the sheet P is moved along the sheet width direction D2 by the fluctuation of the pair of registration rollers 210. As a result thereof, a portion of the sheet P contacting the driving roller 312 of the pair of conveying rollers 310 is also moved along the sheet width direction D2 together with the fluctuation of the driving roller 312. Since the driving roller 312 fluctuates at earlier timing, it is possible to move the sheet P along the sheet width direction D2 at the fluctuation start of the pair of registration rollers 210. In this case, although it is conceivable that the driving roller 312 early fluctuates, the sheet P does is not early moved accompanying with the fluctuation of the driving roller 312 because nip pressure of the pair of registration rollers 210 is high. The fluctuation of the pair of registration rollers 210 and the driving roller 312 of the pair of conveying rollers 310 along the sheet width direction D2 is completed at time t5.

When the sheet P reaches the secondary transfer portion 34, at time t6, the control portion 50 controls the contact/release portion 240 to be driven, thereby starting releasing the contact of the pair of registration rollers 210. Since the pair of conveying rollers 310 has been already away from each other, this released condition is kept. Accordingly, the sheet P is transferred to the secondary transfer portion 34 and conveyed by the secondary transfer portion 34.

When finishing the release of the contact of the pair of registration rollers 210, at time t7, the control portion 50 controls the fluctuation motor 230 to be driven so that the pair of registration rollers 210 can move (return) to their home positions. The control portion 50 also controls the fluctuation motor 330 to be driven so that the driving roller 312 of the pair of conveying rollers 310 can move to its home position.

At time t8, the control portion 50 controls the contact/release portion 440 to start contacting the pair of loop rollers 410, controls the contact/release portion 240 to start contacting the pair of registration rollers 210, and controls the contact/release portion 340 to start contacting the pair of conveying rollers 310. Thus, Preparation for conveying a next sheet to the secondary transfer portion 34 is complete.

As described above, according to the embodiment, when the pair of registration rollers 210 fluctuates along the sheet width direction D2, the driving roller 312 of the pair of conveying rollers 310 which is a pair of conveying member of the second conveying portion of upstream side fluctuates along the sheet width direction D2 while the driving roller 312 and the driven roller 314 constituting the pair of conveying rollers 310 are away from each other. Accordingly, a portion of the sheet P contacting the driving roller 312 can fluctuate at the same time. This prevents any deviation/skew of the sheet P.

Further, the control portion 50 sets an amount of movement of the pair of conveying rollers 310, which is the second conveying portion, along the sheet width direction D2 according to paper weight, species, or size of the sheet P. Even when a sheet is very hard (thick paper) or is a large size sheet, the driving roller 312 of the pair of conveying rollers 310 which the sheet P contacts fluctuates so that it is possible to suppress a phenomenon such that an amount of fluctuation of sheet P is reduced in relation to the amount of fluctuation of the pair of registration rollers 210.

In addition, according to the embodiment, since only the driving roller 312 fluctuates along the sheet width direction D2 under the condition that the pair of conveying rollers 310 is away from each other and do not nip the sheet P, it is possible to surely inhibit a crinkle from occurring on the sheet P without generating any stress as compared with a case where the sheet P fluctuates with it being nipped.

The terms and expressions which have been employed in the foregoing description are used therein as terms of description and not of limitation, and these are no intention, in the use of such terms and expressions, of excluding equivalent of the features shown and described or portions thereof, it being recognized that the scope of the invention is defined and limited only by the claims.

It is to be noted that any technical scope of the claims and/or meaning of term(s) claimed in the claims are not limited to the description in the above-mentioned embodiments. It should be understood by those skilled in the art that various modifications, combinations, sub-combinations and alterations may occur depending on design requirements and other factors insofar as they are within the scope of the appended claims or the equivalents thereof.

Although a case where the second conveying portion 300 is configured to be the pair of conveying rollers 310 has been described in the embodiment, this invention is not limited thereto. For example, the second conveying portion 300 can be configured to be belts.

Further, although a case where this invention is applied to an example in which the registration fluctuation correction is performed when passing the sheet P through the curved path R3 of ADU 60 has been described in the embodiment, this invention is not limited thereto. For example, when the sheet P contacts a pair of conveying rollers arranged at upstream side of the pair of registration rollers 210 along the sheet conveying direction D1 and receives any pressure therefrom during the fluctuation of the sheet P by the pair of registration rollers 210, this invention is applicable to this pair of conveying rollers.

Moreover, although a case where the sheet P contacts the driving roller 312 arranged inside the curved path R3 during the registration fluctuation correction has been described in the embodiment, this invention is not limited thereto. For example, when the sheet P contacts the driven roller 314 arranged outside the curved path R3 because of characteristics of sheet P, conveying path and the like, the driven roller 314 can fluctuate along the sheet width direction D2 while the driven roller 314 is away from the driving roller 312. Further, both of the driven roller 314 and the driving roller 312 may fluctuate along the sheet width direction D2 regardless of whether the sheet P contacts the driven roller 314 or the driving roller 312. In this case, the fluctuation mechanism 250 shown in FIG. 3 can be adopted.

Moreover, although a case where the driving roller 312 of the pair of conveying rollers 310 fluctuates irrespective of the amount of fluctuation of the pair of registration rollers 210 when the pair of registration rollers 210 fluctuates along the sheet width direction D2 has been described in the embodiment, this invention is not limited thereto. For example, the control portion 50 can control the driving roller 312 to prevent it from fluctuating when an amount of fluctuation of the pair of registration rollers 210 is small because less crinkle occurs on the sheet P.

What is claimed is:

1. An image-forming apparatus comprising:

an image-forming portion that forms an image on a sheet;

a pair of first conveying members that is arranged at an upstream side of the image-forming portion along a sheet conveying direction;

a pair of second conveying members that is arranged at an upstream side of the pair of first conveying members along the sheet conveying direction; and a hardware processor configured to;

move the pair of first conveying members along a direction that is orthogonal to the sheet conveying direction while the pair of first conveying members nips the sheet, when conveying the sheet to the image-forming portion, and move at least one of the pair of second conveying members along the direction that is orthogonal to the sheet conveying direction while the pair of second conveying members are released away from each other, when the pair of first conveying members is moved along the direction orthogonal to the sheet conveying direction.

2. The image-forming apparatus according to claim 1 wherein the control portion sets start time of the movement of at least one of the pair of conveying members of the second conveying portion along the direction that is orthogonal to the sheet conveying direction to be before start time of the movement of the pair of conveying members of the first conveying portion along the direction that is orthogonal to the sheet conveying direction.

3. The image-forming apparatus according to claim 1 wherein the control portion sets an amount of the movement of at least one of the pair of conveying members of the second conveying portion along the direction that is orthogonal to the sheet conveying direction to be larger than an amount of the movement of the pair of conveying members of the first conveying portion along the direction that is orthogonal to the sheet conveying direction.

4. The image-forming apparatus according to claim 1 wherein the second conveying portion is arranged on a curved portion of a conveying path.

5. The image-forming apparatus according to claim 1 wherein the control portion sets an amount of the movement of at least one of the pair of conveying members of the second conveying portion along the direction that is orthogonal to the sheet conveying direction based on a paper weight of the sheet, species of sheet or a size of the sheet.

6. The image-forming apparatus according to claim 1 wherein the first conveying portion includes a pair of registration rollers.

7. The image-forming apparatus according to claim 1 wherein the pair of conveying members of the second conveying portion includes a driving roller and a driven roller, and the control portion controls the second conveying portion to move the driving roller along the direction that is orthogonal to the sheet conveying direction.

8. The image-forming apparatus according to claim 1 wherein the pair of conveying members of the second conveying portion includes a driving roller and a driven roller, and the control portion controls the second conveying portion to move the driven roller along the direction that is orthogonal to the sheet conveying direction.

9. The image-forming apparatus according to claim 1, wherein the hardware processor is further configured to move at least one of the pair of second conveying members along the direction orthogonal to the sheet conveying direction in at least a predetermined period during moving of the pair of first conveying members along the direction orthogonal to the sheet conveying direction.

10. The image-forming apparatus according to claim 9, wherein the hardware processor is further configured to release the pair of second conveying members away from each other while the pair of first conveying members nips the sheet.

* * * * *